United States Patent [19]

Bleich

[11] Patent Number: 4,584,759

[45] Date of Patent: Apr. 29, 1986

[54] GRINDING MACHINE WITH MAGAZINE FOR SPARE GRINDING WHEELS

[75] Inventor: Ralf Bleich, Lüneburg, Fed. Rep. of Germany

[73] Assignee: Hauni-Werke Körber & Co. KG., Handburg, Fed. Rep. of Germany

[21] Appl. No.: 701,143

[22] Filed: Feb. 13, 1985

Related U.S. Application Data

[62] Division of Ser. No. 455,884, Jan. 4, 1983, Pat. No. 4,528,743.

[30] Foreign Application Priority Data

Jan. 16, 1982 [DE] Fed. Rep. of Germany ..... 3201206
Dec. 6, 1982 [CH] Switzerland ..... 7070/82

[51] Int. Cl.[4] ..... B23Q 3/157

[52] U.S. Cl. ..... 29/568; 51/262 A; 51/166 R

[58] Field of Search ..... 51/168, 262 A, 262 R, 51/5 R, 166 R, 166 TS, 166 MH, 166 FB; 29/568

[56] References Cited

U.S. PATENT DOCUMENTS 2,804,727 9/1957 Schmidt ..... 51/168
3,627,490 12/1971 Asano ..... 51/168
3,789,472 2/1974 Pegarol ..... 51/168
3,925,878 12/1975 Kikuchi ..... 29/568
4,358,888 11/1982 Zankl et al. ..... 29/568

FOREIGN PATENT DOCUMENTS 29033 7/1972 Japan ..... 29/568
29034 7/1972 Japan ..... 29/568

*Primary Examiner*—Roscoe V. Parker
*Attorney, Agent, or Firm*—Peter K. Kontler

[57] ABSTRACT

A grinding machine wherein the spindle which supports a grinding wheel during removal of material from a workpiece and/or any one of several carriers for spare or substitute grinding wheels are movable relative to each other to positions in which a grinding wheel can be transferred from a selected carrier directly onto the spindle or vice versa. The carriers are mounted in or on a stationary or mobile magazine and their axes can extend radially of a horizontal axis or radially of a vertical axis. The carriers can form one or more rows or one or more annuli. The magazine can be mounted adjacent to the frame of the grinding machine, on a horizontally reciprocable table which supports a vertically or horizontally movable carriage for the spindle, or at a level above the normal level of the spindle.

35 Claims, 8 Drawing Figures

GRINDING MACHINE WITH MAGAZINE FOR SPARE GRINDING WHEELS

This application is a division of application Ser. No. 455,884, filed Jan. 4, 1983, and now U.S. Pat. No. 4,528,743.

BACKGROUND OF THE INVENTION

The present invention relates to improvements in grinding machines and analogous machine tools, and more particularly to improvements in grinding or like machines which are equipped with magazines for spare tools. The term "grinding machine" is intended to embrace machine tools which can be used for grinding, polishing, honing, lapping and/or analogous treatment of workpieces by rotary material removing, smoothing and analogous tools.

It is already known to provide a magazine for spare tools in a wide variety of machine tools, among others in grinding machines. For example, U.S. Pat. No. 2,804,727 to Schmidt discloses an internal grinding machine with a chute for supply of fresh grinding wheels serving to replace successive worn grinding wheels on the tool spindle. The fresh wheels are disposed in a common plane so that their peripheral surfaces contact one another. The mechanism which effects the replacement of a spent wheel with a fresh wheel is designed to remove the spent wheel from the tool spindle, to deliver the removed spent wheel to a disposal location, to remove the foremost fresh wheel from the chute, to transport the thus removed fresh reel to the spindle, and to attach the fresh wheel to the spindle. Even though the patented grinding machine is capable of replacing spent or damaged grinding wheels with successive fresh reels and of disposing of the spent or damaged grinding wheels, the mechanism which is utilized for removal and disposal of spent wheels and for withdrawal, transfer and application of successive fresh wheels is bulky, complex and expensive. Moreover, the just discussed chute and mechanism add little of value to the versatility of the patented grinding machine due to the inability of such machine to reuse one or more grinding wheels.

German Auslegeschrift No. 20 24 212 discloses a magazine which is remote from the machine and wherein the grinding wheels are coaxial with one another. Mechanisms are provided for transport of grinding wheels between the machine and the magazine. Such mechanisms are designed to effect several transfers of a grinding wheel during transport between the magazine and the tool spindle. This contributes to the cost of the assembly including the machine, the magazine and the transfer mechanisms, to the length of intervals which are required to effect the transfer of a grinding wheel, and to the space requirements of the assembly. Moreover, the assembly which is disclosed in the just mentioned German publication also lacks pronounced versatility because it is designed to transport tools in a single direction, namely, to replace spent or damaged grinding wheels with fresh grinding wheels.

OBJECTS AND SUMMARY OF THE INVENTION

An object of the invention is to provide a novel and improved machine tool, especially a grinding or analogous (e.g., polishing, lapping or honing) machine, wherein the transfer of tools between a magazine or another suitable source of supply and the tool spindle or spindles takes place automatically, with little loss in time, and without appreciable outlay for parts.

Another object of the invention is to provide a machine tool whose versatility greatly exceeds that of heretofore known machine tools and whose space requirements are surprisingly small in spite of its pronounced versatility and ability to treat workpieces with any desired number of different tools.

A further object of the invention is to provide a machine tool which can treat a wide variety of simple, medium complex or highly complex workpieces, and which can reuse one or more specific tools as often as desired.

An additional object of the invention is to provide a novel and improved tool magazine for use in a machine tool of the above outlined character.

Another object of the invention is to provide the machine tool with novel and improved means for moving its constituents in several directions preparatory to and after replacement of a first tool on the tool spindle with a different tool as well as preparatory to and for the purpose of adequately storing the first tool.

A further object of the invention is to provide a novel and improved method of manipulating tools preparatory to and during transfer from a magazine onto the tool spindle of a grinding machine or the like, or vice versa.

An additional object of the invention is to provide a grinding or like machine wherein a supply of spare tools cannot interfere with the treatment of workpices but such spare tools are readily and immediately available for automatic transfer onto the tool spindle or spindles.

Another object of the invention is to provide a machine tool which dispenses with discrete tool transfer mechanisms in spite of the fact that its versatility greatly exceeds that of conventional machine tools wherein the tool transfer mechanisms are indispensable.

A further object of the invention is to provide the machine tool with novel and improved means for retaining tools in the magazine and/or on the tool spindle or spindles.

Another object of the invention is to provide the machine tool with novel and improved means which can facilitate automatic discrimination between various spare tools, and with novel and improved means which ensures that each and every spare tool can be accurately fitted into or onto the tool spindle in spite of the presence of dust and other foreign matter in the surrounding area.

A further object of the invention is to provide a novel and improved method of cleaning certain parts of the tool spindle(s) preparatory to the transfer of a fresh tool or when the need arises.

An additional object of the invention is to provide a grinding machine which embodies the above outlined features and whose operation can be controlled automatically or whose operation can be automated to any desired extent.

A further object of the invention is to provide the machine tool with novel and improved means for preventing deterioration or undesirable changes of the condition of spare or fresh tools during storage in the magazine.

An additional object of the invention is to provide a machine tool which can use a single tool at a time or which can be designed for simultaneous utilization of several tools.

The invention resides in the provision of a machine tool, particularly in the provision of a grinding machine, which comprises a tool spindle having first retaining means for releasably retaining a tool (e.g., a customary or a specially designed grinding wheel), a magazine including a plurality of tool carriers each having second retaining means for releasably retaining a spare tool (i.e., a tool which can be used as a substitute for a worn or damaged tool on the spindle or a tool which can be used, at times, in lieu of the tool on the spindle), and moving means for placing the spindle and any selected carrier of the magazine into predetermined mutual positions of register with and sufficiently close to one another to allow for direct transfer of a tool between the first and the respective second retaining means. The moving means can be designed to move only the spindle, to move only the magazine, or to move the magazine and the spindle. Such moving means preferably comprises means for effecting a relative movement between the spindle and the magazine to second mutual positions in which the tool that happens to be held by the first retaining means is free to treat a workpiece without any interference on the part of the magazine and/or those tools which are stored in the magazine. As mentioned above, the tools are or may constitute grinding wheels, and each of the retaining means is then designed to releasably retain grinding wheels, e.g., standard grinding wheels or specially designed grinding wheels. The axis of that carrier whose (second) retaining means is in the process of receiving a tool from the spindle (or vice versa) coincides with the axis of the spindle, at least while the selected carrier and the spindle assume the aforementioned predetermined mutual positions.

The moving means can comprise means for moving the selected carrier and/or the spindle axially of the spindle in order to place the respective second receiving means and the spindle into the predetermined mutual positions. More specifically, the moving means can comprise a table and a carriage which latter supports the spindle and is mounted on the table for movement in a first direction. Such machine tool can further comprise a work holder movable in a second direction which is normal to the first direction. The moving means can further comprise means for moving the table in a third direction which is normal to the first and second directions. One of the first, second and third directions is normally parallel to the axis of the spindle.

In order to place the spindle and a selected carrier into the predetermined mutual positions, the moving means is preferably designed to move the spindle and the selected carrier in at most three directions, preferably in the aforementioned first, second and third directions each of which is normal to the other two directions.

The machine tool can further comprise means for indexing the magazine about a predetermined axis (preferably about a horizontal or about a vertical axis), and the carriers are preferably (but need not always be) equidistant from such predetermined axis. For example, a portion of the magazine can be indexed about a horizontal axis, and the axes of the carriers can be horizontal and parallel to such horizontal axis as well as to the axis of the spindle. If the magazine is indexible about a vertical axis, the axes of the carriers can extend horizontally and radially of the vertical axis. In such a machine tool, the carriers can form one or more annuli whose centers are located on the vertical axis. Alternatively, the magazine can contain one or more rows of carriers, e.g., a substantially horizontal row disposed at a level above the operating level of the spindle. The moving means then includes means for moving the spindle to a first level of register with a selected carrier and a second level below the first level. In such types of magazines, the axes of the carriers are preferably horizontal and parallel to the axis of the spindle.

The magazine can further comprise or support means for cleaning at least a portion of the spindle, e.g., at least a portion of the first retaining means. The moving means then preferably includes means for moving the spindle and the cleaning means to the aforementioned predetermined mutual positions (i.e., the cleaning means then replaces a selected carrier) in which the aforementioned portion of the spindle or its retaining means is within the range of the cleaning means. For example, the just mentioned portion of the spindle can comprise a cone which fits into a complementary recess or socket provided therefor in the cleaning means. The cleaning means can include means for cooling the selected portion or portions of the spindle and/or its retaining means (e.g., a means for discharging and directing one or more streams or jets of hydraulic or gaseous fluid against the aforementioned cone and/or means for wiping the cone. The wiping means can comprise one or more linings consisting of felt or a similar material, or one or more rotary or otherwise movable brushes.

In certain embodiments of the improved machine tool, the moving means can comprise means for moving the selected carrier axially of the spindle.

If the design of the tools is such that each thereof has an axial extension, each of the first and/or second retaining means can comprise at least one gripper which is movable into and from engagement with the extension of the tool which is held by the respective retaining means. Each of the first and/or second retaining means then further comprises means for moving the gripper relative to the tool. The extensions can be provided on or can form part of the hubs of wheel-shaped or disc-like tools, and each of the retaining means can comprise a plurality of grippers which are movable, preferably radially, into and from engagement with the extension of the tool which is held by the respective retaining means. The actuating means can comprise a rod or an analogous member which is reciprocable axially of the tool held by the respective retaining means.

The machine tool can further comprise means for monitoring the dimensions of tools which are held by the carriers. For example, the monitoring means can comprise or constitute a gauge which is designed to determine the diameters of substantially disc-shaped or wheel-shaped tools. Such gauge can be positioned to determine the diameter of the tool which is held by the selected carrier while such carrier and the spindle assume their predetermined mutual positions.

If the moving means comprises a mobile table movably supporting the magazine, the moving means can further comprise means for respectively moving the table and the spindle in first and second directions of right angles to each other.

If the axis of the spindle is substantially horizontal, the magazine can comprise a stationary frame and the moving means can comprise means for moving the spindle with reference to the magazine in a substantially horizontal plane.

The work holder of a machine tool which embodies one or more of the above outlined features can be mounted for movement up and down, and the versatility of the tool can be enhanced if the moving means further comprises means for pivoting the spindle about a substantially vertical axis.

Still further, the machine tool can comprise gears or other suitable means for moving the tools with reference to the magazine. For example, if the tools include wheels or otherwise designed rotary elements, the tool moving means can comprise means for rotating the tools which are held by the carriers so that such tools rotate with reference to the body or housing or support of the magazine. Movability of the tools with reference to the magazine is desirable and advantageous under certain circumstances, e.g., when the tools contain supplies of a fluid which should not remain idle or stagnant in a given position for extended intervals of time.

The novel features which are considered as characteristic of the invention are set forth in particular in the appended claims. The improved machine tool itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
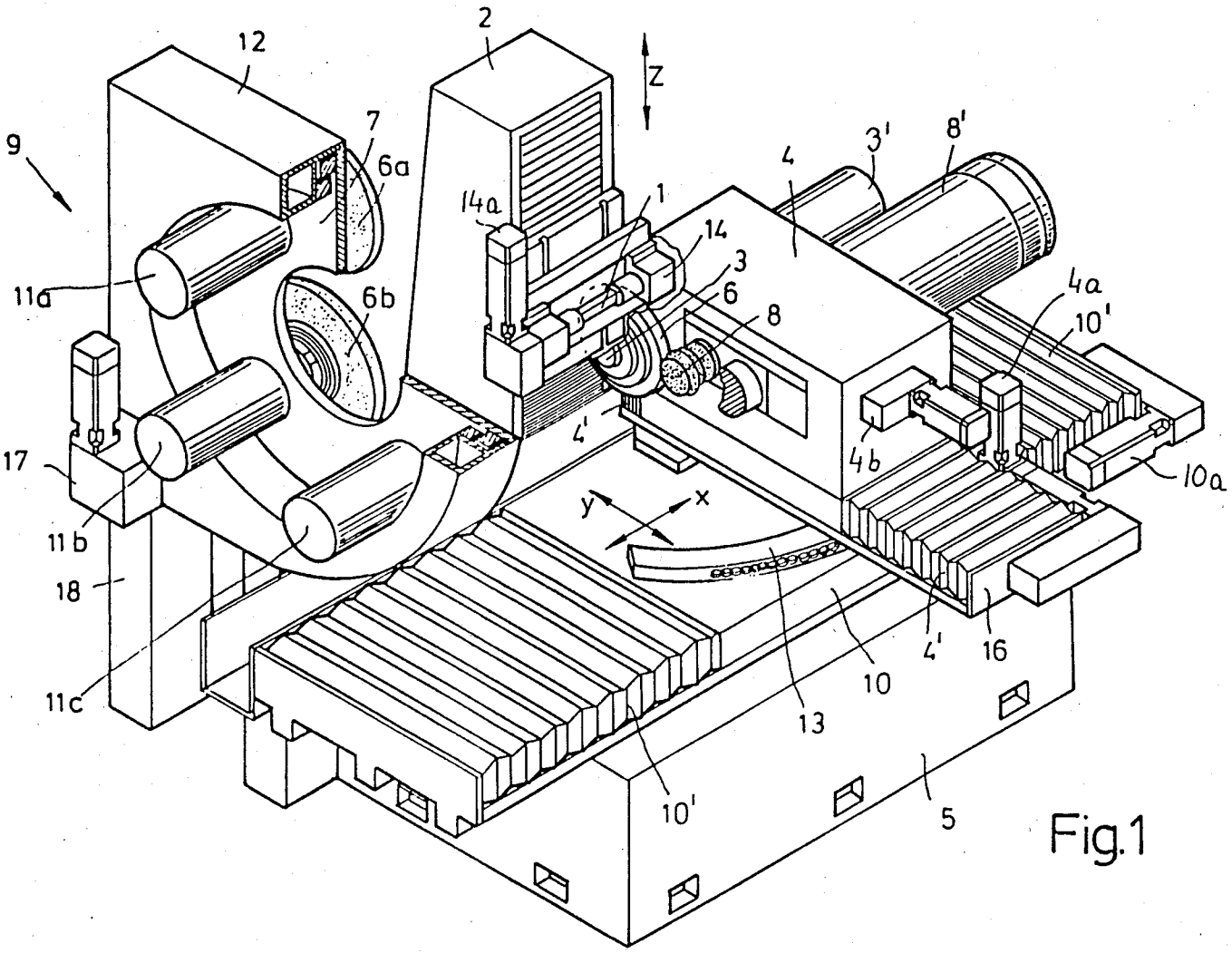
FIG. 1 is a somewhat schematic perspective view of a machine tool which constitutes a grinding machine and embodies one form of the invention, a portion of an indexible tool magazine being broken away.

FIG. 1 shows a machine tool which constitutes a grinding machine with a single tool spindle 3. A workpiece 1, e.g., a blank which is to be treated by a grinding wheel 6 on the tool spindle 3, is mounted on a work holder 14 and the latter is mounted for up-and-down movement along an upright support 2. The directions of vertical reciprocatory movement of the workpiece 1 and its holder 14 relative to the support 2 are indicated by a double-headed arrow Z.

The frame of the machine tool comprises a base or bed 5 supporting a horizontal table 10 which is reciprocable in a horizontal plane in directions indicated by a double-headed arrow X and making a right angle with the directions indicated by the arrow Z. The reference characters 10' denote deformable enclosures, e.g., belows, which confine and conceal the guides or ways provided on the bed 5 and serving to confine the table 10 to movements in the directions indicated by the arrow X. The bellows 10' shield the ways for the table 10 from dust, liquid droplets, chips and/or other foreign matter.

The table 10 supports a horizontal guide or table 16 for a carriage 4 which rotatably supports the tool spindle 3 and is reciprocable in directions indicated by a double-headed arrow Y, namely, in directions extending at right angles to those indicated by the arrows X and Z. The ways which form part of the guide 16 and serve to confine the carriage 4 to movements in the directions indicated by the arrow Y are concealed and shielded by the bellows 4' or analogous enclosures. The axis of the tool spindle 3 is horizontal and normal to the directions indicated by the arrows Y and Z, i.e., such axis is parallel to the directions of reciprocatory movement of the table 10 with reference to the base or bed 5. The working surface of the tool 6 on the front end portion of the tool spindle 6 can be dressed by an apparatus 8 which is rotatably mounted on the carriage 4 and is driven by a motor 8' of any known design. The construction of the dressing apparatus 8 forms no part of the present invention. The apparatus 8 can perform rotary as well as other types of movements with reference to the carriage 4, e.g., to move its diamond or another suitable dressing tool into engagement with the working surface of the grinding wheel 6 on the spindle 3. The latter can be driven by a motor 3' which is mounted on the carriage 4. It will be noted that the carriage 4 and its spindle 3 are movable in a horizontal plane in the directions indicated by the arrows X and Y. This enables the tool spindle 3 to move its tool 6 to any one of a practically infinite number of positions relative to the workpiece 1 in the holder 14 which latter can move the workpiece 1 up and down (arrow Z) in response to actuation of a suitable motor **14*a*** or any other prime mover.

In accordance with a feature of the invention, the machine tool of FIG. 1 further comprises a magazine 9 whose housing or frame 12 is mounted on an upright carrier or column 18 which is secured to the base 5 adjacent to one side of the path of movement of the table 10 in directions indicated by the arrow X. The housing 12 of the magazine 9 is stationary and partially confines a circular disc-shaped support 7 which is indexible about a horizontal axis extending in parallelism with the axis of the spindle 3. The support 7 mounts four equidistant carriers of which only three (namely, the carriers **11*a*, 11*b* and 11*c*) can be seen in FIG. 1. The axes of the carriers are parallel to the axis of the support 7, and each carrier is provided with a retaining mechanism for a discrete tool, such as a spare grinding wheel. FIG. 1 shows two spare grinding wheels 6*a*, 6*b* which are respectively held by the retaining mechanisms of the carriers 11*a* and 11*b*. The means for indexing the support 7 about its horizontal axis includes a geneva movement 17 or another suitable mechanism that is capable of rotating the support 7** at a desired speed and through increments of selected magnitude, either stepwise or continuously.

The means for moving the spindle 3 and any selected carrier on the support 7 to predetermined mutual positions in which the wheel 6 can be transferred into the magazine 9 or in which a wheel (such as 6*a*) can be transferred from its carrier (11*a*) onto the spindle 3 includes the aforementioned table 10, a reversible motor 10*a* for reciprocating the table 10, the carriage 4, a reversible motor 4*a* for reciprocating the carriage 4 along the guide 16, and the indexing mechanism 17 for the support 7. In order to enable the illustrated machine tool to treat a wide variety of more or less complex or highly complex workpieces, the table or guide 16 is preferably pivotable about a vertical axis which is normal to the axis of the spindle 3. To this end, the top face of the table 10 has arcuate ways 13 along which the carriage 4 can travel in response to starting of a reversible motor 4*b*. The pivotability of the carriage 4 about a vertical axis enables the tool on the spindle 3 to treat facetted or otherwise configurated workpieces, i.e., workpiece having one or more surfaces which could not be reached and/or properly treated in the absence of movability of the spindle 3 and its carriage 4 about a vertical axis which is parallel to the directions indicated by the arrow Z.

The operation of the grinding machine of FIG. 1, and more particularly the mode of transferring tools between the magazine 9 and the tool spindle 3, is as follows:

The carriage 4 for the spindle 3 is moved in one of the directions indicated by the arrow X and, if necessary, in one of the directions indicated by the arrow Y in a horizontal plane so that the spindle 3 is coaxial with the carrier 11*c*, namely, with that carrier whose retaining mechanism does not support a grinding wheel. The indexing of the disc-shaped support 7 to the illustrated angular position can precede or take place simultaneously with shifting of the spindle 3 to the aforementioned position. The transfer of the grinding wheel 6 from the retaining mechanism of the spindle 3 to the retaining mechanism of the carrier 11*c* takes place directly and preferably automatically (in a manner to be described hereinafter). Such automatic transfer can take place due to the selected construction of the retaining mechanism of the spindle 3 and of the retaining mechanisms of the carriers which are mounted on the indexible support 7. Thus, the improved machine tool can dispense with one or more discrete transfer mechanisms which are needed in conventional grinding machines with magazines or analogous storing means for spare grinding wheels.

When the transfer of the grinding wheel 6 onto the carrier 11*c* is completed, the support 7 is indexed to move a selected spare grinding wheel (e.g., the grinding wheel 6*a*) into register with the spindle 3 (this might necessitate some retraction of the spindle), and the selected spare grinding wheel is automatically transferred directly from the retaining mechanism of the carrier 11*a* to the retaining mechanism of the spindle. The spindle 3 is then moved axially (i.e., in the direction of arrow X) and, if necessary, with the carriage 4 along the path which is defined by the guide 16, to move the freshly accepted grinding wheel 6*a* to an optimum position with reference to the workpiece 1 on the work holder 14.

FIG. 1 merely shows three carriers 11*a*, 11*b* and 11*c*, and only two spare grinding wheels 6*a* and 6*b*. It will be readily appreciated, however, that the number of carriers on the support 7 can be increased well beyond three without departing from the spirit of the invention. Also, the number of carriers can be reduced to two, and it is equally within the purview of the invention to provide a magazine for spare grinding wheels which are to be attached to the carriers on the support 7.

It is often preferred to slowly rotate the support 7 while the machine tool is in actual use, i.e., while the grinding wheel 6 or another grinding wheel treats a workpiece 1. This ensures that any liquid which may be confined in or applied to a portion of the exterior of the grinding wheels which are stored in the magazine 9 cannot accumulate at an improper location or drip off the spare tools by gravity. Eccentric accumulations of liquids in or on the spare grinding wheels can interfere with or prevent accurate centering or balancing when such spare tools are transferred onto the tool spindle 3. It is also possible to avoid continuous or substantially continuous rotation of the support 7 with the carriers 11*a*–11*c* and spare grinding wheels 6*a*, 6*a*. Instead, the frame or housing 12 can contain a driven ring gear meshing with discrete gears on the carriers 11*a*–11*c* to maintain the respective spare grinding wheels in motion while the support 7 is idle. Thus, the motor 17 can cause the spare grinding wheels to orbit about the axis of the support 7, or each of the carriers on the support 7 can be caused to rotate the corresponding spare grinding wheel about its respective axis.

Figure 2:
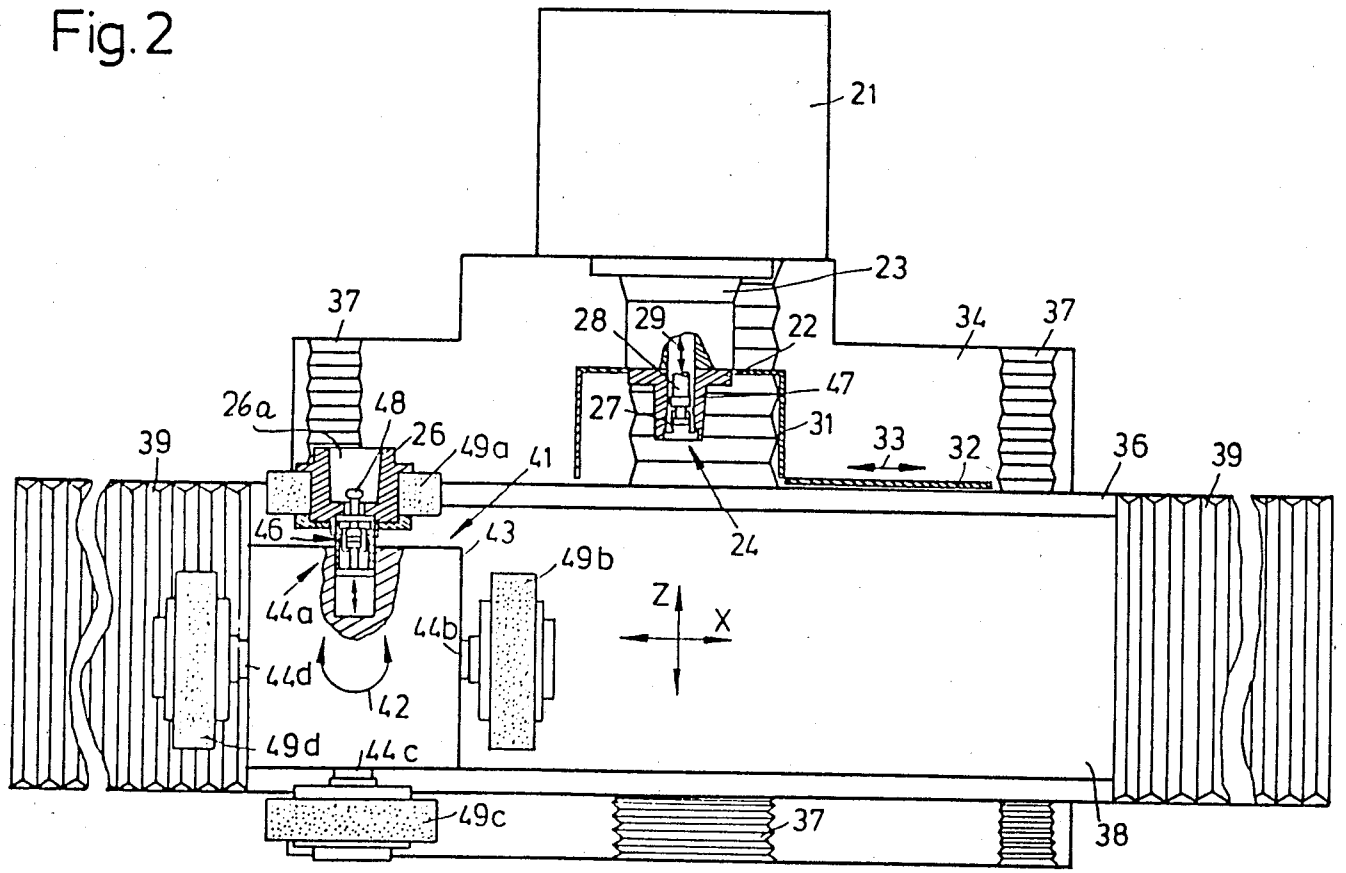
FIG. 2 is a schematic partial top plan and partial horizontal sectional view of a grinding machine with a modified magazine for an annulus of spare tools.

FIG. 2 shows a portion of a modified machine tool which is a surface grinding machine and whose construction departs, in several respects, from the construction of the grinding machine shown in FIG. 1. The frame of the grinding machine shown in FIG. 2 includes an upright supporting member 21 for a carriage 23 which supports a horizontal tool spindle 22 and is movable up and down at right angles to the plane of FIG. 2. The front end portion of the spindle 22 is provided with a retaining mechanism 24 which can engage and releasably hold the hub of a grinding wheel, e.g., the hub 26 of one of the four grinding wheels 49*a*, 49*b*, 49*c*, 49*d* shown in FIG. 2 on a modified magazine 41 having a block-shaped holder 43 which is indexible about a vertical axis, i.e., about an axis which is normal to the axis of the spindle 22 and is parallel to the directions of reciprocatory movement of the carriage 23. The retaining mechanism 24 comprises a set of equidistant grippers or claws 27 which are pivotable by an axially reciprocable (note the arrow 29) actuating element 28 in the form of a pull rod. The grippers 27 release the hub 26 of a grinding wheel which is mounted on the spindle 22 when the actuating rod 28 is moved in one direction, and such grippers move into engagement with the hub of a grinding wheel on the spindle 22 when the rod 28 is moved in the opposite direction. The means for moving the actuating rod 28 back and forth, as indicated by the double-headed arrow 29, can comprise a hydraulic, pneumatic or electro-magnetic motor, a reversible electric motor, or any other suitable prime mover which can be started and arrested in response to appropriate signals, e.g., in response to signals from limit switches which are used to monitor the position of the tool spindle 22 with reference to a selected carrier 44*a*, 44*b*, 44*c* or 44*d* of the magazine 41. Somewhat similar modes of holding a grinding wheel on its spindle are already known in the art.

The spindle 22 is surrounded by a protecting housing or shroud 31 whose front wall or panel 32 is movable in directions indicated by a double-headed arrow 33 so as to either conceal and confine the grinding wheel on the spindle 22 while such grinding wheel removes material from a workpiece, or to enable the spindle 22 to assume a predetermined position for transfer of a grinding wheel from its retaining mechanism 24 to the retaining mechanism 46 of one of the carriers 44*a*–44*d*, or vice versa.

The frame of the grinding machine of FIG. 2 further comprises a base or bed 34, and the means for moving the spindle 22 and a selected carrier 49*a*, 49*b*, 49*c* or 49*d* to predetermined mutual positions comprises a horizontal table-like support 36 which is reciprocable on the bed 34 in directions indicated by the arrow Z, namely, in parallelism with the axis of the spindle 22, and indirectly supports the aforementioned magazine 41. The ways for the table 36 are provided on the bed 34, and those portions of such ways which are not engaged by the complementary portions of the table 36 are concealed by bellows 37 or other suitable contamination-preventing enclosures.

The table 36 supports a second horizontal table 38 which also forms part of the aforementioned moving means and is movable on the table 36 in directions indicated by the double-headed arrow X, namely, at right angles to the axis of the spindle 22. The table 36 has ways for the table 38, and those portions of such ways which are not engaged by the table 38 are confined in bellows 39 or other suitable contamination-preventing enclosures. The work holder (not shown in FIG. 2) is mounted on the upper table 38 so that it can be moved with reference to the spindle 22 while the latter rotates so that the tool thereon is ready to remove material from the workpiece. By moving the tables 36, 38 is directions indicated by the arrow X and/or Z, an operator can move the workpiece to any of a practically infinite number of positions with reference to the tool on the spindle 22.

Figure 6:
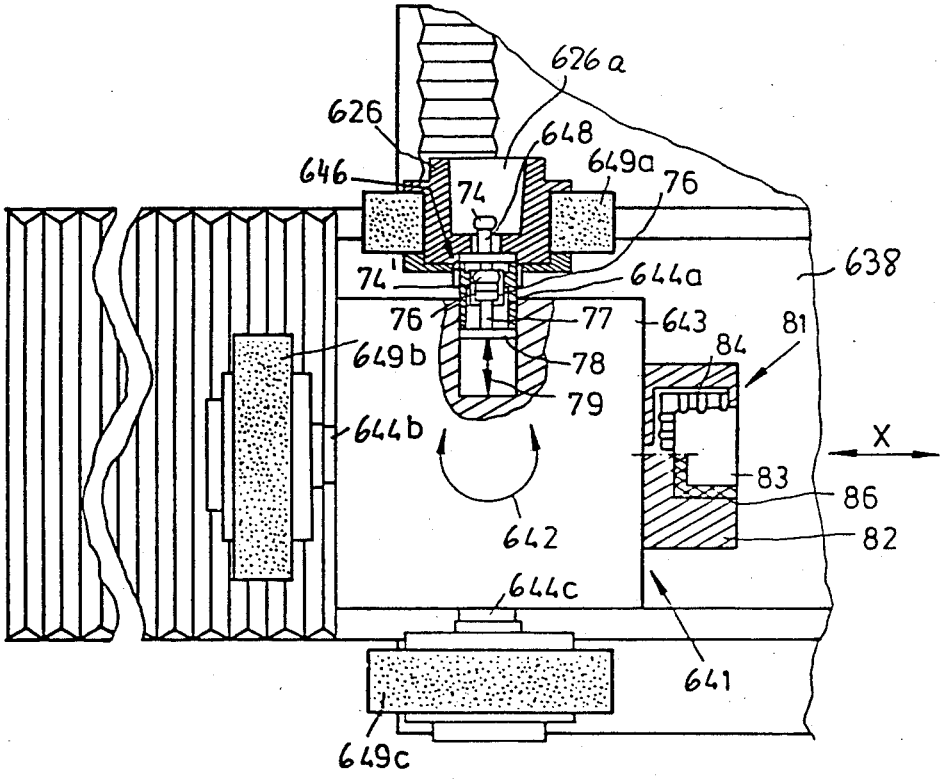
FIG. 6 is a fragmentary plan view of a fifth grinding machine wherein the magazine carries a device for cleaning the tool spindle.

The aforementioned magazine 41 is indexibly supported by the upper table 38 so that it can share the movements of the table 38 with or relative to the lower table 36. The polygonal or otherwise configurated block-shaped holder 43 of the magazine 41 supports the carriers 44*a*–44*d* in such a way that the axes of grinding wheels 49*a*–49*d* on the respective carriers extend radially of the axis about which the block 43 is indexible relative to the upper table 38. Each of the four carriers 44*a*–44*d* comprises a retaining mechanism 46 the details of which are shown in FIG. 6. FIG. 2 merely shows that the hub 26 of the grinding wheel 49*a* has an axial extension with two heads (one shown at 48) one of which can be engaged by the grippers 27 of the retaining mechanism 24 and the other of which can be engaged by the retaining mechanism 46 of the carrier 44*a*. The hubs of the other spare tools 49*b*–49*d* shown in FIG. 2 are preferably identical with the hub 26 of the grinding wheel 49*a*.

In FIG. 2, the spindle 22 and the magazine 41 assume second mutual positions in which the spare grinding wheels 49*a*–49*d* cannot interfere with the treatment of a workpiece mounted in or on a work holder which is assumed to be located in front of the spindle 22. In order to cause the spindle 22 and the selected carrier 44*a*, 44*b*, 44*c* or 44*d* of the magazine 41 to assume their predetermined mutual positions in which the retaining mechanism 24 of the spindle can accept a grinding wheel from the retaining mechanism 46 of a selected carrier on the holder 43 of the magazine 41, the spindle 22 is moved (if necessary) at right angles to the plane of FIG. 2 so that its axis is located in the common plane of the axes of the grinding wheels 49*a*–49*d*, and the table 38 is moved with and/or relative to the table 36 so as to place a selected carrier (e.g., the carrier 44*a*) into register with the spindle. The axis of the grinding wheel 49*a* then coincides with the axis of the spindle 22 on the carriage 23. In the next step, the table 36 is moved in the direction of the axis of the spindle 22 and toward the upright supporting member 21 so that the frustoconical stub 47 (hereinafter called cone) at the front end of the spindle 22 enters the complementary conical recess or socket 26*a* in the hub 26 of the selected grinding wheel 49*a*. During such penetration of the cone 47 into the socket 26*a*, the grippers 27 of the retaining mechanism 24 are held in open positions so that the head 48 of the extension forming part of the hub 26 can penetrate into the space between the spaced-apart grippers 27. The actuating rod 29 is thereupon shifted in the axial direction of the spindle 22 so that the grippers 27 pivot radially of the cone 47 and engage the head 48. At the same time, a reciprocable actuating element causes the grippers of the retaining mechanism 46 on the carrier 44*a* to release the other head of the extension so that the grinding wheel 49*a* is then held exclusively by the retaining mechanism 24 and the magazine 41 can be retracted by moving the table 36 along its ways and away from the upright supporting member 21. The table 38 is thereupon shifted along the table 36 (arrow X) so that the remaining spare grinding wheels 49*b*–49*d* are moved out of the way and the work holder moves a workpiece into proper position for treatment by the selected grinding wheel 49*a*. Prior to proceeding with the treatment of the workpiece, the front wall 32 of the shroud 31 is returned to its operative position to confine dust, chips, liquid droplets and other contaminants in the interior of the shroud.

The aforedescribed procedure is repeated in reverse when the grinding wheel 49*a* is to be returned onto the carrier 44*a*, i.e., when such grinding wheel is to be reengaged by the retaining mechanism 46 of the carrier 44*a*. The table 36 is thereupon temporarily retracted in a direction away from the upright supporting member 21 so as to provide room for indexing of the magazine 41, and the table 36 is then moved toward the supporting member 21 so as to enable the retaining mechanism 24 of the spindle 22 to accept another grinding wheel (49*b*, 49*c* or 49*d*, depending on the extent of indexing of the magazine 41 prior to such transfer of a spare grinding wheel onto the spindle). The directions in which the holder 43 of the magazine 41 can be indexed are indicated by a double-headed arrow 42. Of course, it is equally possible to select the indexing means (not specifically shown) for the holder 43 in such a way that the latter can rotate in a single direction.

The grinding wheels on the holder 43 of the magazine 41 can be replaced with different grinding wheels while the magazine 41 dwells in the illustrated position, i.e., such replacement or interchange of spare grinding wheels can take place while the grinding wheel which is held by the retaining mechanism 24 treats a workpiece. This contributes to a reduction of down times because the replacement of spare grinding wheels on the holder 43 does not necessitate any, even very short lasting, interruption of operation, i.e., of the treatment of a workpiece by the grinding wheel on the spindle 22.

Figure 3:
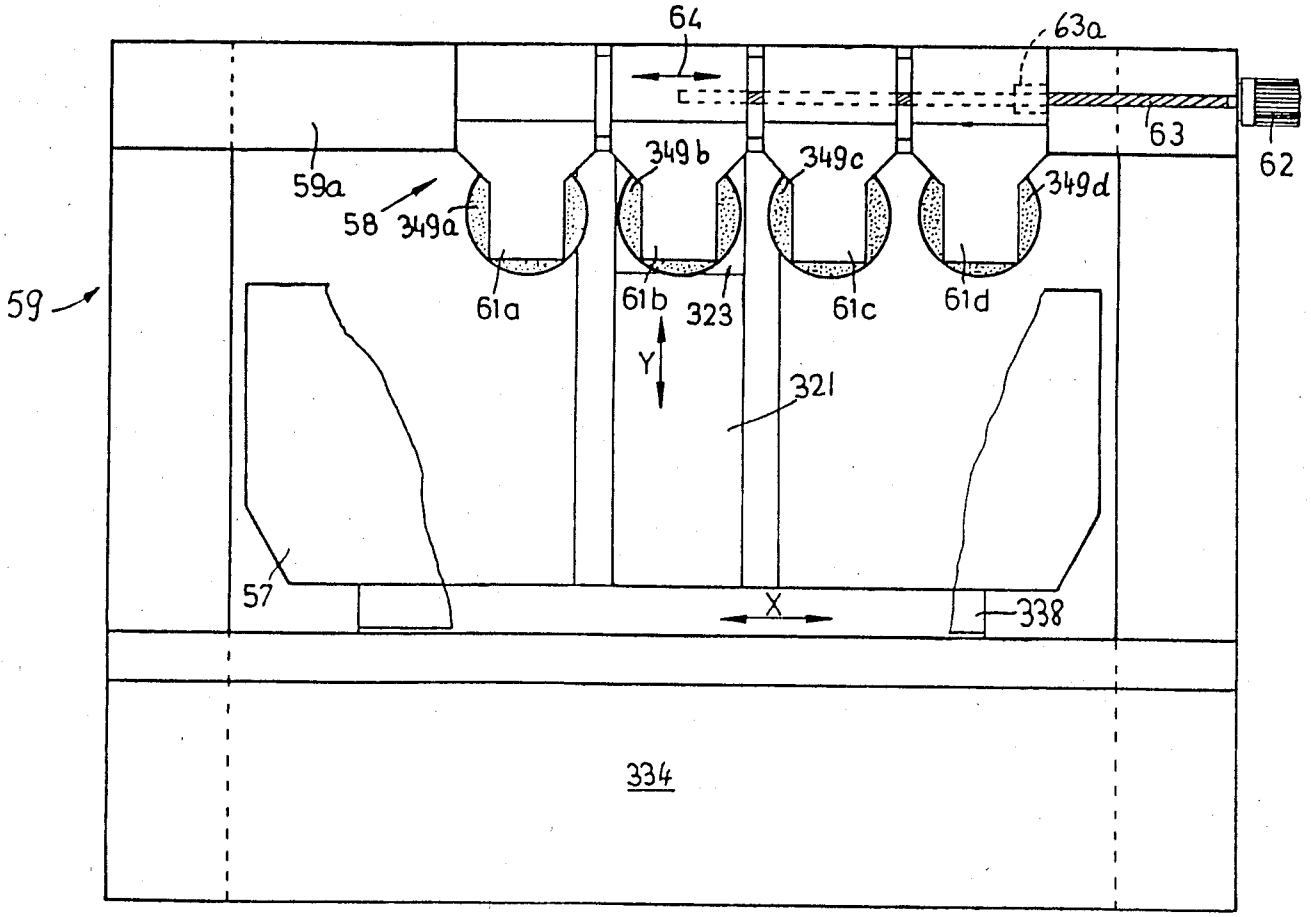
FIG. 3 is a diagrammatic front elevational view of a third grinding machine employing a straight horizontal magazine which is installed at a level above the operative position of the tool spindle.
Figure 4:
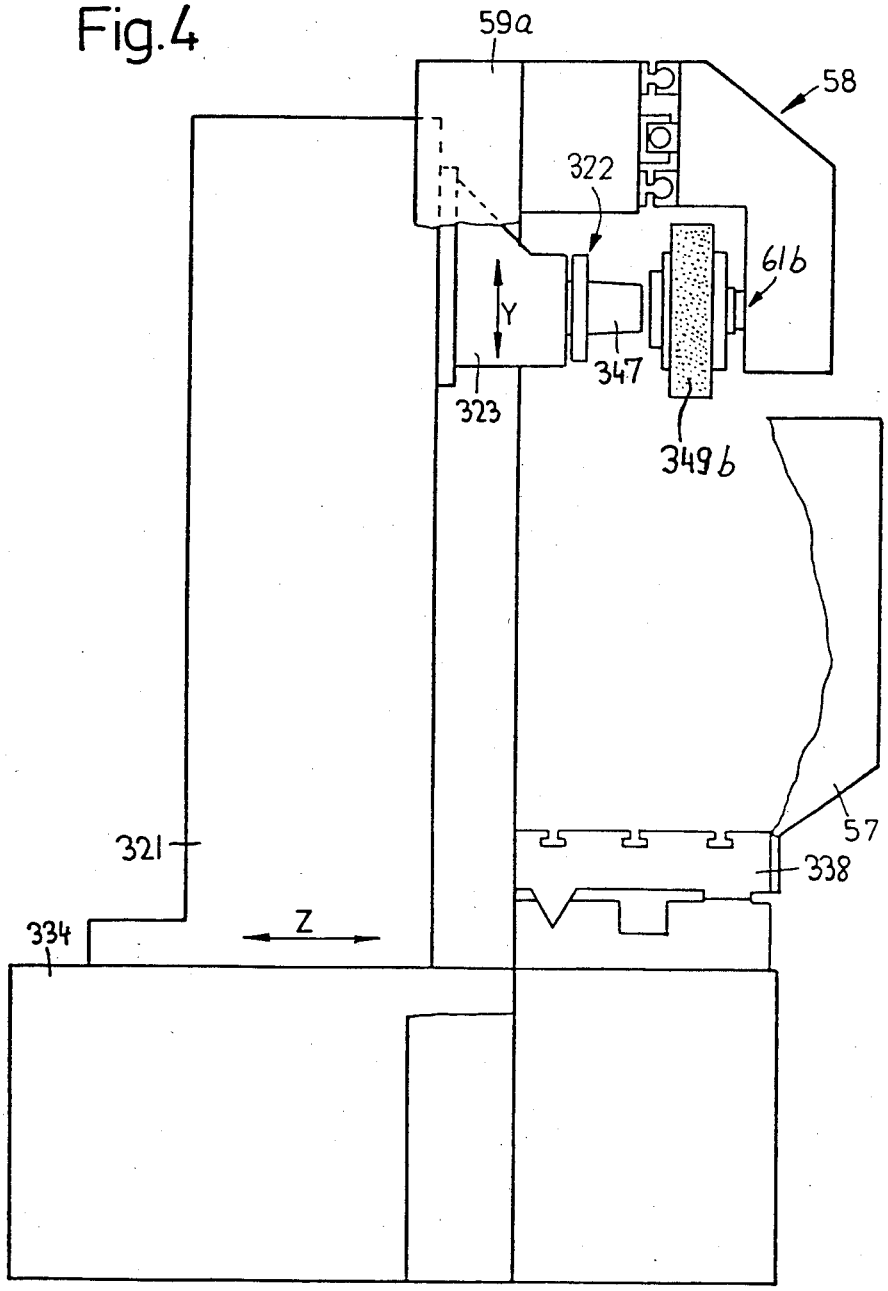
FIG. 4 is a diagrammatic end elevational view of the third grinding machine as seen from the left-hand side of FIG. 3.

FIGS. 3 and 4 show a third machine tool which also constitutes a grinding machine. All such parts of this grinding machine which are identical with or clearly analogous to the corresponding parts of the machine shown in FIG. 2 are denoted by similar reference characters plus 300. The base or bed 334 of the grinding machine which is shown in FIGS. 3 and 4 carries an upright supporting member 321 which is reciprocable in directions indicated by a double-headed arrow Z, namely, in parallelism which the axis of the tool spindle 322 whose cone is shown at 347 and which is rotatable in a carriage 323. The latter is movable up and down by a motor which is not specifically shown in the drawing. The directions of reciprocatory movement of the carriage 323 along the upright supporting member 321 are indicated by a double-headed arrow Y.

The base or bed 334 further supports a horizontal table 338 which is reciprocable in directions indicated by a double-headed arrow X. The directions which are indicated by the arrow X are normal to those indicated by the arrows Y and Z, and the directions indicated by the arrow Y are normal to those indicated by the arrow Z.

The working station is surrounded by a shroud or hood 57 which is closed when the grinding wheel on the cone 347 of the spindle 322 is in the process of treating a workpiece, not shown. The shroud 57 is mounted on the table 338, together with the non-illustrated workpiece holder.

The grinding machine of FIGS. 3 and 4 further comprises a linear (straight) magazine 58 which is mounted on a gantry-like support 59 at a level above the working station, i.e., above the shroud 57 and above the normal level of the spindle 322. The support 59 can be mounted on the bed 334 or directly on the floor. The means for moving the magazine 58 back and forth (note the arrow 64) along the horizontal top portion 59*a* of the support 59 comprises a reversible electric motor 62 and a feed screw 63 driven by the motor 62 and meshing with a nut 63*a* of the magazine. The magazine 58 supports a series of parallel horizontal carriers 61*a*, 61*b*, 61*c*, 61*d*, one for each of a set of spare grinding wheels 349*a*, 349*b*, 349*c*, 349*d*. The axes of the carriers are parallel to the axis of the spindle 322.

A selected spare grinding wheel can be moved into register with the spindle 322 by moving the magazine 58 along the top portion 59*a* of the support 59. In order to thereupon transfer a grinding wheel (e.g., the wheel 349*b*) from the magazine 58 onto the cone 347 of the spindle 322, the upright supporting member 321 is moved to the right, as viewed in FIG. 4, so that the conical socket of such grinding wheel receives the cone 347 and the retaining mechanism in the cone 347 engages the adjacent head of the extension of the hub of the grinding wheel 349*b* while the retaining mechanism of the corresponding carrier 61*b* simultaneously releases the other head of the extension. The just described procedure is repeated in reverse if the tool which is carrier by the cone 347 is to be transferred back into the magazine 58, i.e., onto an empty carrier.

The grinding machine of FIGS. 3 and 4 exhibits the advantage that the magazine 58 is permanently out of the way when the machine is in actual use because the spindle 322 is then at a level well below that shown in FIG. 4. Moreover, the magazine 58 is preferably installed at a level above the head of an operator attending the machine so that the magazine does not occupy any space behind, at the one or the other side or in front of the bed 334. In other words, the magazine 58 is located outside of the actual working area in or around the machine.

The transfer of a grinding wheel from the magazine 58 onto the cone 347 or vice versa is preceded first by a movement of the spindle 322 from its normal operating level to the level of the common plane of the axes of the carriers 61*a* to 61*d* so that a selected grinding wheel in the magazine, or an unoccupied carrier of the magazine, can be brought into axial alignment with the spindle by shifting the magazine 58 lengthwise of the support portion 59*a*. The movement of the spindle 322 to the level of FIG. 4 can take place simultaneously with movement of the selected carrier 61*a*, 61*b*, 61*c* or 61*d* into axial alignment with the spindle, i.e., with movement of the axis of such selected carrier into the vertical plane including the axis of the spindle 322.

The magazine 58 can be replaced with a magazine which comprises two or more horizontal rows of carriers for discrete grinding wheels. Such a magazine will be used in grinding machines which employ large numbers of grinding wheels to carry out a certain type of treatment of workpieces. The spindle 322 is then movable to a first level at which its tool treats a workpiece within the confines of the shroud 57, and several additional levels, one for each row of carriers in the overhead magazine.

Figure 5:
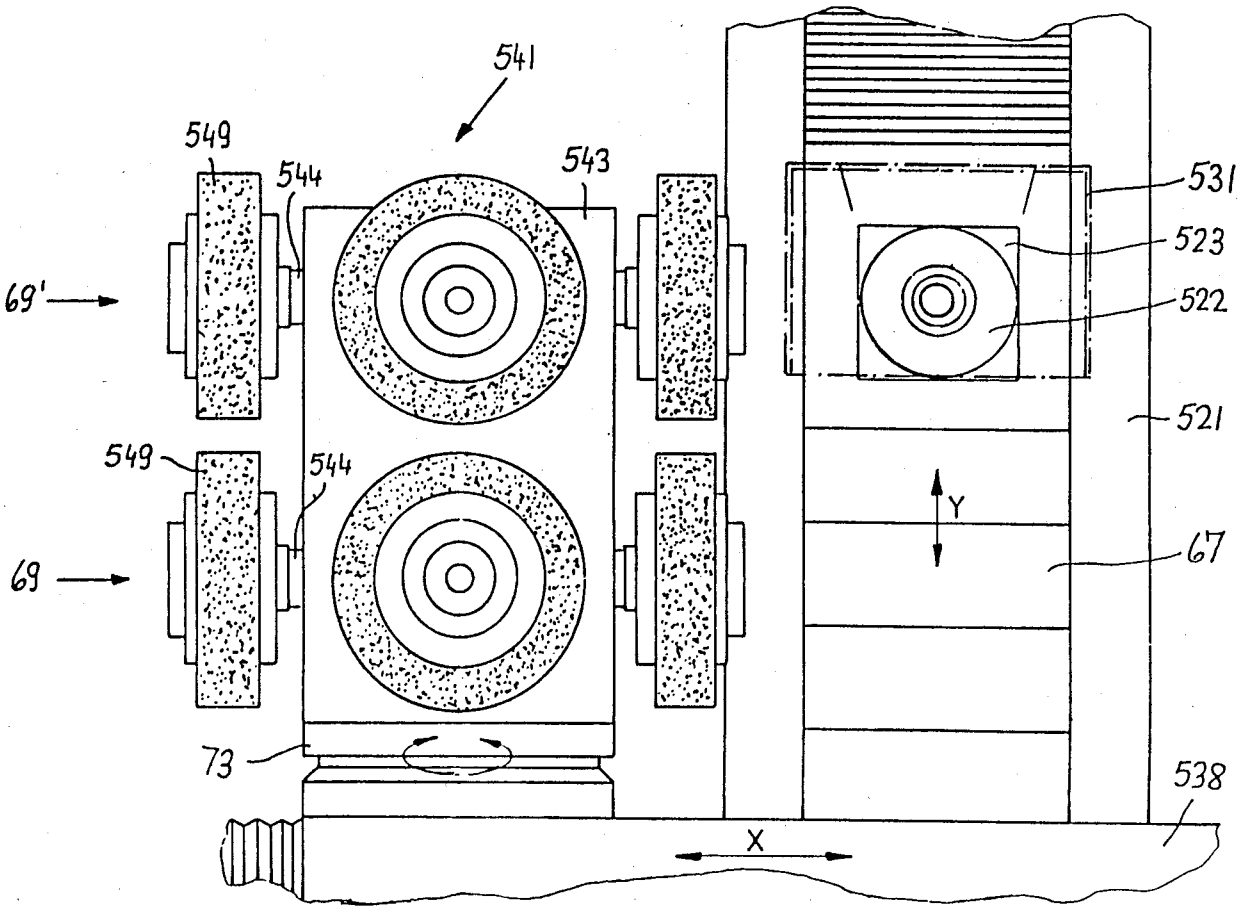
FIG. 5 is a fragmentary front elevational view of a fourth grinding machine employing a magazine which constitutes a modification of the magazine shown in FIG. 2.

FIG. 5 shows a portion of a fourth grinding machine wherein all such parts which are identical with or clearly analogous to the corresponding parts of the machine shown in FIG. 2 are denoted by similar reference characters plus 500. The upright supporting member 521 guides a vertically reciprocable carriage 523 for a horizontal tool spindle 522 which is driven by a suitable motor and shares all movements of the carriage 523 in the directions indicated by an arrow Y. The spindle 522 is normally surrounded by a protecting shroud 531, and the vertical guide means for the carriage 523 are normally concealed by shiftable sheet metal panels 67 or the like so that the guide means are shielded from dust, liquid droplets and/or other contaminants. A table 538 is reciprocable in directions which are indicated by an arrow X and supports a magazine 541 including a holder 543 which is indexible about a vertical axis parallel to the directions indicated by the arrow Y. The holder 543 carriers two annuli of spare grinding wheels 549, namely a first annulus of four equidistant grinding wheels at an upper level 69′ and a second annulus of four equidistant grinding wheels 549 at a lower level 69 (it being assumed that the cone of the spindle 522 does not carry a grinding wheel). The horizontal axis of each upper grinding wheel 549 is located in a common vertical plane with the horizontal axis of one of the four lower grinding wheels. The indexing mechanism 73 for the magazine 541 is disposed at a level below the holder 543. The carriers 544 for the grinding wheels 549 and the receiving mechanisms of such carriers may be similar to or identical with those shown in FIG. 2. The mechanism 73 can further comprise suitable detent means for releasably maintaining the holder 543 in any one of four different angular positions in which a selected grinding wheel of each of the two annuli of wheels faces away from the observer of FIG. 5 so that the axes of such grinding wheels are parallel to the axis of the spindle 522 and either of these grinding wheels can be transferred onto the cone of the spindle, depending on the selected level of the spindle during transfer of a grinding wheel from the retaining mechanism of the selected carrier 544 to the retaining mechanism of the spindle. Indexing mechanisms which can be used in the grinding machine of FIG. 5 to support and rotate a magazine or the like through angles of predetermined magnitude are available on the market. For example, they are offered for sale (under the designation "automatic indexing tables") by the firm SMP at 69500 Bron, France.

An advantage of a grinding machine which embodies the structure of FIG. 5 is that the magazine 541 can store a substantial number of spare grinding wheels 549 without adversely affecting the facility of transfer of a selected grinding wheel from the magazine onto the spindle 522 or vice versa. The number of spare grinding wheels can be increased still further by increasing the number of grinding wheels in each annulus (e.g., to six by indexing the holder 543 through angles of 60°) and/or by increasing the number of annuli to three or more. This merely involves the need for moving the spindle 522 (in one of the directions indicated by the arrow Y) to any one of a corresponding number of different levels so as to place the axis of the spindle into the plane of common axes of grinding wheels 549 in a selected annulus.

Another advantage of the grinding machine which utilizes the magazine 541 or a similar magazine is that a substantial number of spare grinding wheels can be stored in a small area and, if desired, close or very close to the tool spindle.

A further advantage of the structure of FIG. 5 is that it can be used in grinding machines of the type employing several parallel tool spindles. Reference may be had, for example, to the commonly owned copending patent application Ser. No. 232,250 filed Jan. 6, 1981 by Werner Redeker et al., now U.S. Pat. No. 4,417,422 granted Nov. 29, 1983. If the magazine 541 is installed in a two-spindle grinding machine, both spindles can receive, or can be relieved of, grinding wheels in one and the same operation. If the distance between the two spindles is fixed, it corresponds to the distance between the levels 69 and 69'.

FIG. 6 is a plan view of a portion of a grinding machine which constitutes a further modification of the machine shown in FIG. 2. All such parts which are identical with or clearly analogous to the corresponding parts of the machine of FIG. 2 are denoted by similar reference characters plus 600. The magazine 641 is reciprocable with the table 638 in directions indicated by the arrow X and has a holder 643 which is indexible stepwise about a vertical axis in directions indicated by an arrow 642, namely, in parallelism with the axis of the tool spindle, not shown. The mechanism for indexing the magazine 641 can be similar to or identical with the mechanism 73 of FIG. 5. The holder 643 supports three carriers 644*a*, 644*b*, 644*c* with discrete retaining mechanisms 646 each of which can hold a spare grinding wheel (649*a*, 649*b*, 649*c*). Each grinding wheel has a hub 626 with a conical socket 626*a* for the cone of the tool spindle, and each grinding wheel further comprises a rod-like extension 648 with two heads 74 (extending into the socket 626*a*) and 74'. The retaining mechanism 646 of the carrier 644*a* shown in FIG. 6 includes a set of jaws or grippers 76 which are movable radially in response to axial movement of an actuating member 77 constituting the piston rod of a piston 78 in a double-acting cylinder defined by the holder 643. The arrow 79 indicates the directions of reciprocatory movement of the piston 78. The means for admitting a pressurized hydraulic or gaseous fluid to the one or the other side of the piston 78 is not specifically shown in FIG. 6. The grippers 76 are pivotally connected to the actuating member 77 and perform movements into engagement with the head 74' when the member 77 is caused to move in one direction (axially of the carrier 644*a*) and away from engagement with the head 74' when the actuating member 77 moves in the opposite direction.

The magazine 641 further includes a cleaning device 81 which is mounted on the holder 643 so that it can be indexed into register with the tool spindle by rotating the holder 643 through 90° in a counterclockwise direction, as viewed in FIG. 6. The purpose of the device 81 is to clean or similarly treat a portion of the spindle, preferably the cone corresponding to the part 47 shown in FIG. 2. The cleaning device 81 comprises a housing or casing 82 defining a conical socket 83 which is complementary to and can receive the cone of the tool spindle. The wiping means of the cleaning device 81 comprises a lining 86 of felt or a similar material and/or one or more rotary brushes, not specifically shown. Furthermore, the housing 82 is formed with one or more ports 84 for one or more streams of a hydraulic or gaseous fluid which is directed against and can cool and/or remove impurities from the cone of the tool spindle. The arrangement can be such that, prior to accepting a grinding wheel, the tool spindle is moved into the range of the cleaning device 81 which mechanically, hydraulically and/or pneumatically cleans the cone of the tool spindle before the holder 643 is indexed to a position in which a selected grinding wheel registers with and can be transferred onto the freshly cleaned cone of the spindle. This ensures predictable retention and positioning of grinding wheels on the tool spindle irrespective of the presence or absence of contaminants in the area around such spindle. The cleaning operation can be performed in a fully automatic way, i.e., the movements of the tool spindle and of the magazine 641 can be programmed so that each transfer of a grinding wheel onto the cone of the tool spindle is preceded by a cleaning of the cone. The transfer of grinding wheels onto and their removal from the cone of the tool spindle are preferably automated in a manner not specifically shown in the drawing but being readily comprehensible to those skilled in the art. Such automation of the transfer of grinding wheels can be assisted by a set of limit switches, sensors or other types of position monitoring devices, and an evaluating system which initiates the operation of various components of moving means for the tool spindle and the magazine preparatory and during transfer of grinding wheels between the retaining mechanism of the tool spindle and the retaining mechanism of a selected carrier.

The provision of a cleaning device directly in or on the magazine further reduces the down times of the improved machine because the tool spindle can be cleaned automatically prior to attachment of a grinding wheel thereto. This takes up much less time than manual cleaning of the spindle and/or cleaning with a separate cleaning device which must be moved to requisite position with reference to the spindle by means other than the parts that serve to move the work holder and/or the tool spindle during or preparatory to normal operation of the grinding machine.

The controls of the improved grinding machine can be designed in such a way that the cleaning of the spindle takes place automatically prior to attachment of a grinding wheel thereto. This is desirable and advantageous because it invariably ensures that each and every grinding wheel is attached to the spindle in an optimum position for treatment of one or more workpieces. The outlay for controls which ensure automatic cleaning of the spindle prior to attachment of a grinding wheel thereto is minimal, especially when compared with the overall cost of a numerically controlled grinding machine or an analogous machine tool.

Figure 7:
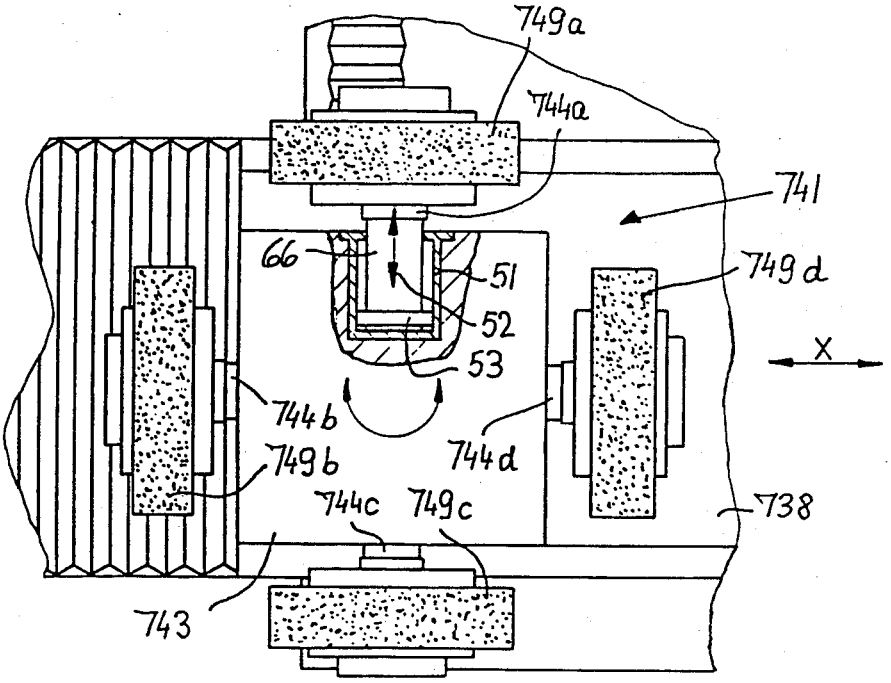
FIG. 7 is a plan view of a grinding machine with a magazine which is indexible about a vertical axis and is provided with modified means for releasably coupling tools to its carriers.

FIG. 7 illustrates a portion of a grinding machine which constitutes another modification of the machine tool shown in FIG. 2. All such parts of the machine of FIG. 7 which are identical with or clearly analogous to corresponding parts of the machine of FIG. 2 are denoted by similar reference characters plus 700. The magazine 741 is indexible about a vertical axis and is mounted on a table 738 which is reciprocable in directions indicated by a double-headed arrow X. The holder 743 of the magazine 741 supports four axially movable carriers 744*a*, 744*b*, 744*c*, 744*d* for spare grinding wheels 749*a*, 749*b*, 749*c*, 749*d*. The retaining mechanisms of the carriers 644*a*–644*d* are confined in cylindrical casings 66 which can be said to constitute piston rods of pistons 53 reciprocable in cylinders 51 which are inserted into the holder 743. The arrow 52 indicates the directions of reciprocatory movement of the piston 53 and casing 66 forming part of or containing the retaining mechanism of the carrier 744*a*. The piston 53 can be reciprocated pneumatically, hydraulically, electromagnetically or by an electric motor to move the corresponding carrier axially.

The magazine 741 is especially suitable for use in or with machine tools wherein the tool spindle is not movable axially, i.e., where it is necessary to move the entire retaining mechanism (casing 66) of a carrier (744*a*, 744*b*, 744*c* or 744*d*) or the entire carrier axially of the spindle so that the spindle can accept a spare grinding wheel or that a grinding wheel can be removed from the spindle. Also, the magazine 741 can be used with advantage in machine tools axially of the tool spindle, i.e., where it is necessary to move the retaining mechanism of a selected carrier 744*a*, 744*b*, 744*c* or 744*d* with reference to the holder 743 of the magazine.

Figure 8:
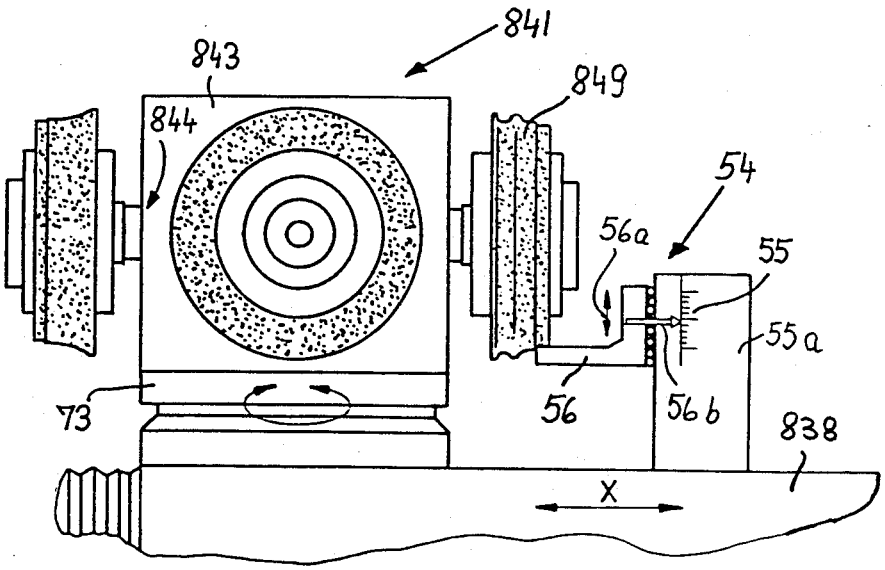
FIG. 8 is a fragmentary elevational view of a further grinding machine wherein the frame supports a device for monitoring the dimensions of spare tools.

Referring finally to FIG. 8, there is shown a portion of a grinding machine with a table 838 which is reciprocable in directions indicated by an arrow X and supports a magazine 841 which comprises a holder 843 with four equidistant carriers 844 for discrete grinding wheels 849. The indexing mechanism for the holder 843 is shown at 73. The table 838 further supports a tool identifying or monitoring device 54 which is a gauge serving to ascertain the diameter of a selected spare grinding wheel 849 while such grinding wheel is supported by the retaining mechanism of the respective carrier 844 on the holder 843. The gauge 54 comprises a sensor arm 56 which is movable in directions indicated by a double-headed arrow 56*a* to move into contact with the working surface of the adjacent grinding wheel 849. The arm 56 carries a pointer 56*b* movable along a scale 55 provided on a bracket 55*a* which is secured to the table 838. The gauge 54 can be used to identify a selected grinding wheel 849, e.g., prior to movement of such grinding wheel to a position for transfer onto the tool spindle, and the gauge can be designed to produce signals which not only denote the diameter of the adjacent grinding wheel but also serve to effect further movements of the indexing mechanism 73, table 838 and/or other components of moving means of the grinding machine in order to move the freshly monitored grinding wheel to a position for transfer onto the cone of the tool spindle. Still further, the gauge 54 can be used to generate signals which control the operation of the dressing apparatus, such as the dressing apparatus 8 of FIG. 1. The scale 55 can be replaced by the wire of a potentiometer which transmits signals denoting the monitored dimension (diameter) of the adjacent grinding wheel 849 and serving to automatically regulate one or more functions in moving the selected grinding wheel into proper position relative to the dressing tool or vice versa and/or in moving the selected grinding wheel into proper position with reference to the tool spindle.

The provision of the monitoring device 54, together with the provision of the aforediscussed cleaning device 81 or an analogous cleaning device, contributes significantly to reliability of operation and to a reduction of down times of the machine because each and every tool can be mounted on the spindle with a maximum degree of precision and the placing of a selected grinding wheel to a position for transfer onto the spindle takes up little time since the dimensions and/or other characteristics of the grinding wheel are ascertained by the device 54 before the grinding wheel is transferred onto the spindle. The monitoring device 54 can also ascertain the condition of the monitored grinding wheel and can generate signals denoting the detection of a defective spare grinding wheel in the magazine.

The magazine of each grinding machine which embodies the invention can be provided with means for ensuring that the supply or supplies of liquid in or on the tools in the magazine will not lead to unbalance as a result of prolonged storage of such tools in the magazine. Thus, each and every magazine can be kept in motion while it is held out of the way of the spindle and the work holder, and/or each magazine can be provided with means for rotating the stored grinding wheels about their respective axes to prevent one-sided accumulations of flowable media therein.

If desired, the improved grinding machine can be provided with several magazines, e.g., an overhead magazine of the type shown in FIGS. 3 and 4 and an indexible magazine of the type shown in FIG. 1 or 2. This also contributes to versatility of the improved machine.

It is already known to construct a grinding machine in such a way that the work holder can move in first and second directions at right angles to one another and that the tool spindle can move in a third direction at right angles to the first and second directions, or vice versa. However, such movability of the spindle in a conventional machine is not used to enhance the transfer of spare grinding wheels onto or the removal of grinding wheels from the spindle. In the majority of conventional grinding machines, the tool spindle is horizontal and its carriage is movable up and down along an upright supporting member at right angles to the axis of the spindle. In such machines, the table and the work holder are movable in a horizontal plane. The situation is somewhat different in certain special grinding machines in which the directions of movement of the table, tool spindle and work holder are selected in a different way.

The present invention takes advantage of movability of the tool spindle and of the means for moving the work holder to ensure direct and rapid transfer of spare grinding wheels from a magazine onto the tool spindle or direct transfer of a grinding wheel from the spindle into the magazine. This is accomplished without resort to separate transfer mechanisms which are essential in conventional grinding machines with magazines for spare grinding wheels wherein the transfer of grinding wheels invariably takes place in a single direction, namely, from the magazine toward the spindle. Moreover, direct transfer of grinding wheels from the magazine onto the tool spindle or vice versa can be accomplished without increasing the number of directions in which the spindle and the work holder must move in order to ensure adequate treatment of a wide variety of workpieces. In other words, movements in the directions indicated by the arrows X, Y and Z are sufficient to ensure the just discussed direct two-directional transfer of spare grinding wheels without resort to complex, bulky and expensive auxiliary mechanisms.

Each of the spare grinding wheels preferably occupies a predetermined position in the interior of the magazine. This renders it possible to automate the transfer of grinding wheels between the magazine and the tool spindle because the position of each grinding wheel which is confined in the magazine can be readily memorized by an automatic transfer system. Moreover, the transfer takes up short intervals of time because the automatic transfer system need not ascertain the position of a given spare grinding wheel by trial and error, and the same holds true for detection of an unoccupied carrier preparatory to transfer of a grinding wheel from the tool spindle into the magazine.

Resort to movements of the spindle and/or magazine in the directions indicated by the arrows X, Y and Z simplifies the construction of the grinding machine because the means for moving the spindle and/or the magazine in such directions is or can be the same as that which is needed in conventional machines to move the work holder and the spindle relative to one another and which, in the improved machine, is used not only to move the spindle and a selected carrier to predetermined mutual positions but also to move the spindle and the work holder with reference to each other. The placing of carriers at the same distance from the axis of rotation of their support or from the axis about which the entire magazine is indexible relative to the respective component of the moving means also contributes to rapid and convenient placing of selected carriers into register with the spindle.

A further advantage of the improved grinding machine is that it can be constructed and assembled by carrying out relatively inexpensive alterations of conventional grinding machines. For example, a numerically controlled grinding machine, wherein the tool spindle is movable up and down and the work holder is movable in two different directions in a substantially horizontal plane, can be readily converted into a grinding machine which embodies the present invention by the simple but unobvious expedient of adding the improved magazine and of modifying the controls so as to allow for direct and preferably fully automatic transfer of spare tools between the tool spindle and a selected carrier of the magazine. The efficiency of the improved grinding machine is surprisingly high because the intervals of idleness which are needed to effect the transfer of a tool between the magazine and the tool spindle are surprisingly short, primarily due to the fact that the transfer of tools takes place directly, i.e., without resort to one or more mechanisms which remove the tools from the magazine, which transport the removed tools toward the spindle, and which apply the thus transported tools to the spindle. The combined down times of the improved machine per shift or per week are but a small fraction of the combined down times in conventional grinding machines which employ the same number of different grinding wheels for the treatment of a given workpiece or for the treatment of a given series of discrete workpieces. As stated above, the magazine can store spare grinding wheels which are to be used as substitutes for spent or damaged grinding wheels and/or spare grinding wheels which are to be used for certain periods of time to be thereupon reintroduced into the magazine for future use. It is often simpler to replace a grinding wheel with a different grinding wheel rather than to remove the workpiece from its holder and reinsert such workpiece in a different position so that the workpiece can be treated by one and the same grinding wheel. This holds especially true when the replacement of grinding wheels can take place directly, i.e., in a manner as disclosed above in connection with FIGS. 1 to 8.

It has been found that the versatility of the improved grinding machine is incomparably higher than that of heretofore known grinding machines.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a grinding machine, the combination of a rotary tool spindle having first retaining means for releasably holding a tool; a magazine including at least one annulus of tool carriers each having a substantially horizontal axis and each including second retaining means for releasably holding a tool; means for indexing said magazine about a predetermined substantially vertical axis, said annulus of carriers having a center located on said predetermined axis; a work table movably supporting said magazine; and means for respectively moving said table and said spindle in first and second directions at right angles to one another.

2. The combination of claim 1, further comprising moving means for placing said spindle and any selected carrier of said magazine into predetermined mutual positions of register with and sufficiently close to one another to allow for direct transfer of a tool between said first and the respective second retaining means.

3. The combination of claim 2, wherein said moving means includes means for effecting a relative movement between said spindle and said magazine to second mutual positions in which the tool which is held by said first retaining means is free to treat a workpiece.

4. The combination of claim 2, wherein the axis of the selected carrier coincides with the axis of said spindle in said predetermined mutual positions of such selected carrier and said spindle.

5. The combination of claim 4, wherein said moving means includes means for moving the selected carrier and/or the spindle axially of the spindle in order to place the spindle and the selected carrier into said predetermined mutual positions.

6. The combination of claim 5, wherein said moving means comprises a table and a carriage supporting said spindle and mounted on said table for movement in a first direction, and further comprising work holder means movable in a second direction normal to said first direction.

7. The combination of claim 5, wherein said moving means further comprises means for moving said table in a third direction normal to said first and second directions, one of said directions being parallel to the axis of said spindle.

8. The combination of claim 2 wherein, in order to place said spindle and a selected carrier to said predetermined mutual positions, said moving means includes means for effecting movements of said spindle and the selected carrier in at most three directions each of which is at least substantially normal to the other two directions.

9. The combination of claim 1; wherein said retaining means are constructed and assembled to releasably hold grinding wheels.

10. The combination of claim 1, wherein said carriers are equidistant from said predetermined axis.

11. The combination of claim 1, further comprising means for monitoring the dimensions of tools which are held by said carriers.

12. The combination of claim 11, wherein said monitoring means comprises a gauge arranged to determine the diameters of substantially disc-shaped tools.

13. The combination of claim 12, wherein said gauge is positioned to determine the diameter of the tool held by the selected carrier while such carrier and said spindle assume predetermined mutual positions.

14. The combination of claim 1, wherein the axis of said spindle is substantially horizontal and said magazine further comprises a stationary frame, and further comprising means for moving said spindle with reference to said magazine in a substantially horizontal plane.

15. The combination of claim 1, further comprising a work holder and means for moving said work holder up and down.

16. The combination of claim 1, further comprising means for pivoting said spindle about a substantially vertical axis.

17. The combination of claim 1, further comprising means for moving the tools with reference to said magazine.

18. The combination of claim 1, wherein the tools include wheels and further comprising means for rotating the wheels which are held by said carriers with reference to the magazine.

19. The combination of claim 1, wherein said carriers form several annuli which are disposed at different levels.

20. In a machine tool, particularly in a grinding machine, the combination of a rotary spindle having first retaining means for releasably holding a tool having an axial extension; a magazine including at least one annulus of tool carriers each having a substantially horizontal axis and each including second retaining means for releasably holding a tool, each of said second retaining means including at least one gripper movable into and from engagement with the extension of the tool which is held by the respective carrier and actuating means for moving the gripper relative to the tool; and means for indexing said magazine about a predetermined substantially vertical axis, said annulus of carriers having a center located on said predetermined axis.

21. The combination of claim 20, wherein said magazine further comprises means for cleaning at least a portion of said spindle.

22. The combination of claim 21, further comprising means for moving said spindle and said cleaning means to predetermined mutual positions in which said portion of the spindle is within the range of said cleaning means.

23. The combination of claim 21, wherein said cleaning means includes means for cooling said portion of said spindle.

24. The combination of claim 21, wherein said cleaning means includes means for directing at least one stream of a fluid medium against said portion of said spindle.

25. The combination of claim 21, wherein said cleaning means comprises means for wiping said portion of said spindle.

26. The combination of claim 25, wherein said wiping means comprises at least one lining consisting of felt or the like.

27. The combination of claim 25, wherein said wiping means comprises at least one brush.

28. The combination of claim 21, wherein each tool has a hub and the extension is provided on such hub, each second retaining means comprising a plurality of grippers.

29. The combination of claim 28, wherein the actuating means of each of said second retaining means comprises a member which is reciprocable axially of the tool held by the respective carrier.

30. In a machine tool, particularly in a grinding machine, the combination of a rotary tool spindle having first retaining means for releasably holding a tool; a magazine including at least one annulus of tool carriers each having a substantially horizontal axis and each including second retaining means for releasably holding a tool, and means for cleaning at least a portion of said spindle; means for moving said spindle and said cleaning means to predetermined mutual positions in which said portion of the spindle is within the range of said cleaning means; and means for indexing said magazine about a predetermined substantially vertical axis, said annulus of carriers having a center located on said predetermined axis.

31. The combination of claim 30, wherein said portion of said spindle includes a cone.

32. The combination of claim 31, wherein said cleaning means comprises a socket complementary to and arranged to receive said cone.

33. The combination of claim 31, wherein said moving means includes means for moving the selected carrier axially of said spindle.

34. In a machine tool, particularly in a grinding machine, the combination of a rotary tool spindle having first retaining means for releasably holding a tool; a magazine including at least one annulus of tool carriers each having a substantially horizontal axis and each including second retaining means for releasably holding a tool, and means for cleaning at least a portion of said spindle including means for cooling said portion of said spindle; and means for indexing said magazine about a predetermined substantially vertical axis, said annulus of carriers having a center located on said predetermined axis.

35. In a machine tool, particularly in a grinding machine, the combination of a rotary tool spindle having first retaining means for releasably holding a tool; a magazine including at least one annulus of tool carriers each having a substantially horizontal axis and each including second retaining means for releasably holding a tool, and means for cleaning at least a portion of said spindle including means for directing at least one stream of a fluid medium against said portion of said spindle; and means for indexing said magazine about a predetermined substantially vertical axis, said annulus of carriers having a center located on said predetermined axis.

* * * * *